United States Patent [19]

Tagashira et al.

[11] 4,200,390

[45] Apr. 29, 1980

[54] COMBINED COPYING AND PRINTING APPARATUS

[75] Inventors: Satoshi Tagashira, Yokohama; Akira Motegi, Yokosuka; Toshio Ishiguro, Yokohama, all of Japan

[73] Assignees: Hitachi Seiko Ltd.; Konishiriku Photo Ind., Co., Ltd., both of Japan

[21] Appl. No.: 912,420

[22] Filed: Jun. 5, 1978

[30] Foreign Application Priority Data

Jun. 3, 1977 [JP] Japan ..... 52/64689

[51] Int. Cl.[2] ..... G03G 15/00

[52] U.S. Cl. ..... 355/14 R; 101/142; 101/DIG. 13; 355/3 R

[58] Field of Search ..... 355/3 R, 14; 101/DIG. 13, 141, 142, 144, 132.5, 450, 451, 453, 463

[56] References Cited

U.S. PATENT DOCUMENTS

| | | | |
|---|---|---|---|
| 3,648,603 | 3/1972 | Kaminstein | 101/132.5 |
| 3,682,095 | 8/1972 | Kaminstein et al. | 101/450 X |
| 3,821,931 | 7/1974 | Yamaji et al. | 101/451 X |
| 3,861,306 | 1/1975 | Dubois et al. | 101/132.5 X |
| 4,080,060 | 3/1978 | Nothmann | 101/132.5 X |
| 4,134,341 | 1/1979 | Weigele et al. | 355/14 X |

*Primary Examiner*—R. L. Moses

*Attorney, Agent, or Firm*—Craig and Antonelli

[57] ABSTRACT

A copying and printing apparatus comprising an integral combination of an electronic copying device and a printing device in which, in the print mode, the image of an original is copied on a master sheet in the electronic copying device to be used as a printing master for producing the desired number of prints in the printing device, while in the copy mode, the image of an original is copied on copying sheets to produce the desired number of copies in the electronic copying device. A sheet delivery changeover mechanism is provided between the electronic copying device and the printing device to be selectively placed in the print position and copy position depending on the print mode or copy mode.

8 Claims, 8 Drawing Figures

COMBINED COPYING AND PRINTING APPARATUS

LIST OF PRIOR ART REFERENCES (37 CFR 1.56(a)) The following references are cited to show the state of the art:

1. Japanese Pat. Pub. No. 46-4611 (Corresponding to DAS No. 1,761,513)
2. Japanese Pat. Pub. No. 45-16609 (Corresponding to U.S.P. at No. 3,426,678)
2. Japanese Utility Model Publication No. 46-27610 (Corresponding to U.S.P. at No. 3,451,336)

This invention relates to copying and printing apparatus capable of providing reproductions of originals such as pages of a book, not only in the form of copies obtained by electronic copying but also in the form of prints obtained by printing, and more particularly to a copying and printing apparatus comprising an integral combination of an electronic copying device and a printing device. The term "reproduction" is used herein to designate both a copy and a print.

An electronic copying device and a small-sized printing device are most frequently used for obtaining reproductions of originals such as pages of a book. The former or electronic copying device is suitable for producing a relatively medium number of reproductions, while the latter or small-sized printing device is suitable for producing a large number of reproductions. This is because, when the former device is used for producing a large number of reproductions the copying cost per reproduction is higher than the printing cost per reproduction produced by the latter device, and in addition, an extended length of time is required for producing a large number of reproductions, while when the latter device is used for producing a small number of reproductions, the printing cost per reproduction is higher than the copying cost per reproduction produced by the former device, and in addition, an extended length of time is required for producing a small number of reproductions, due to the necessity for the preparation of a printing master. Thus, as is well known, an electronic copying device is advantageous in cost over a small-sized printing device when the number of reproductions to be produced is less than a boundary value, while the latter is advantageous in cost over the former when the number of reproductions to be produced is more than the boundary value. It has therefore been proposed to provide a system which includes both of such an electronic copying device and such a printing device so that the electronic copying device can be used for producing a small number of reproductions and for preparing a printing master to be used in the printing device for producing a large number of reproductions. However, due to the necessity for the manual handling of the printing copy which is produced by the electronic copying device and is then subjected to various necessary processing steps to be used as the printing master, the proposed system has been defective in that the printing master tends to be fouled by, for example, the finger mark of the operator, and the operator's skill is required for mounting the printing master in printing position in the printing device. In an effort to obviate these defects, a so-called total copying system has been invented in which a device for preparing a printing master by means of electronic copying is coupled to a printing device by a printing master transfer device so as to avoid intervention of an operator in the steps of printing master preparation and printing and to simplify the copying and printing processes. This system has however been defective in that the electronic copying section is used solely for the purpose of preparing the printing master, and a reproduction produced directly by means of electronic copying (which reproduction is used as a final copy) cannot be directly taken out of the electronic copying section, due to the fact that the printing master preparing device is coupled directly to the printing device. Thus, even when a small number of reproductions are desired, these reproductions can only be delivered from the printing device, and the proposed system does not obviate the defects of the printing device in that the cost of printing such a small number of reproductions is quite high, and an extended length of time is required for obtaining the reproductions. Further, the operating efficiency of the proposed system is very low due to the fact that the printing master preparing device cannot start to produce a succeeding printing master until the printing by the preceding printing master in the printing device has been completed.

It is therefore a primary object of the present invention to provide a novel and improved copying and printing apparatus which can efficiently produce reproductions with an economically acceptable cost, which can be simply operated, and which is relatively small in size.

Another object of the present invention is to provide a copying and printing apparatus comprising in combination an electronic copying device and a printing device so that the same or different reproductions can be delivered from the individual devices as desired at the same time.

Still another object of the present invention is to provide a full automatic type of copying and printing apparatus of the above character in which both the electronic copying device and the printing device can be sufficiently conveniently handled by a single operator.

Yet another object of the present invention is to provide a copying and printing apparatus of the above character in which a reproduction produced by the electronic copying device can be automatically turned into a printing master and automatically supplied to the printing device without the need for intervention of the operator.

According to the basic feature of the copying and printing apparatus of the present invention, the copying and printing apparatus comprises an integral combination of an electronic copying device and a printing device each including an actuating system controlled by a controlled system. In the operation of the copying and printing apparatus according to the basic feature of the present invention, the electronic copying device and the printing device are automatically controlled depending on a "copy" mode or a "PRINT" mode so that, when the "copy" mode is specified, reproductions produced by the electronic copying device are delivered as final copies therefrom independently of the control by the control system portions associated with the printing device, while when the "PRINT" mode is specified, reproductions produced by the electronic copying device are supplied sequentially to a buffer section (corresponding to the stock tray 34 mentioned hereinafter) as intermediate copies, and the sequential order of the supplied copies is stored in a memory by the action of the control system portions associated with the printing device independently of the control by the control system portions associated with the copying device. In the printing device, the intermediate copies are taken out one after another from the buffer section in the sequential order stored in the memory and are sequentially mounted on a plate cylinder after being turned into printing masters so that the printing masters can be used to provide any desired number of prints for each individual intermediate copy, and such prints can be delivered from the printing device in the sequential order. Thus, the printing operation of the printing device can be carried out independently of the copying operation of the electronic copying device so as to obtain the desired prints on the basis of the reproductions produced by the electronic copying device. Therefore, the printing time required for obtaining the desired prints can be remarkably shortened due to the fact that it is utterly necessary to stop the operation of the electronic copying device until printing of a required number of prints for each page of a book has been completed in the printing device, and also it is unnecessary to start printing by the printing device after copying of all the pages of the book has been completed in the electronic copying device. Further, the prints thus obtained are arranged in the order of the pages of the book due to the fact that the sequential order of copying by the electronic copying device is stored in the memory, and the copies are supplied, after being turned into the printing masters, to the printing device according to the sequential order stored in the memory. Furthermore, the copying and printing apparatus of the present invention can operate with improved efficiency due to the fact that the electronic copying device can be operated for copying an original for obtaining copies or prints of such an original even when the printing device is making its printing operation, once the copying operation on the preceding original by the electronic copying device has been completed.

According to another important feature of the present invention, the electronic copying device includes means for comparing the number of copies or prints instructed by the operator with a predetermined setting or limit so as to specify the "PRINT" mode when the former is larger than the latter, and the "copy" mode when the former is smaller than the latter. Thus, reproductions can be economically provided under the automatic decision of the copying and printing apparatus without requiring the decision of the operator as to which of copying and printing is economically preferable.

According to still another important feature of the present invention, the electronic copying device includes a first stocker for stocking copying sheets for the purpose of production of copies and a second stocker for stocking master sheets for the purpose of preparation of printing masters, and means are provided for supplying the copying sheets or master sheets from the first or second stocker depending on whether the electronic copying device is placed in the "COPY" mode or "PRINT" mode. Thus, the consumption of expensive master sheets for use as the printing masters can be reduced to a minimum, and the total cost of these sheets can be cut down.

The basic copying mechanism of the electronic copying device in the copying and printing apparatus according to the present invention may be similar to that used in known dry or wet electronic copying devices. Also, the basic printing mechanism of the printing device in the copying and printing apparatus according to the present invention may be any one of known printing mechanisms, for example, the printing mechanism used in a conventional three-cylinder offset printing press or two-cylinder direct printing press. When the printing mechanism of the two-cylinder direct printing press is employed in the apparatus of the present invention, the electronic copying device is advantageously provided with an optical system which can be selectively changed over to one of the projecting positions so as to project a positive image or a mirror image depending on the "COPY" mode or "PRINT" mode.

The above and other objects and features of the present invention will become more apparent from the following detailed description of preferred embodiments thereof taken in conjunction with the accompanying drawings, in which.

Figure 4:
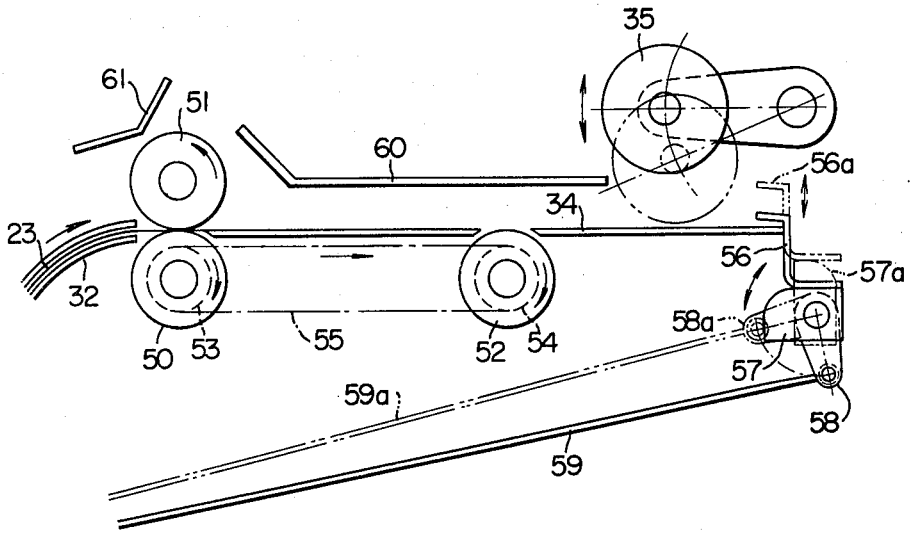
FIG. 4 is an enlarged schematic elevational view showing the structure of stock trays surrounded by the two-dot chain lines in FIGS. 1 and 3.
Figure 5A:
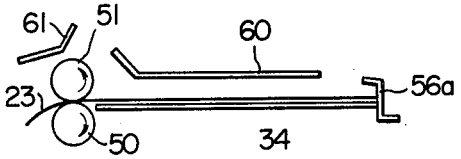
Figure 5B:
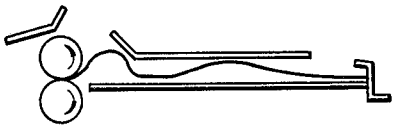
Figure 5C:
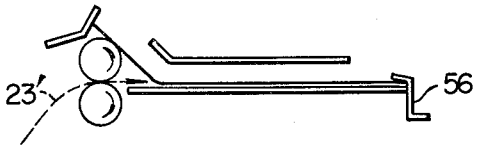
Figure 6:
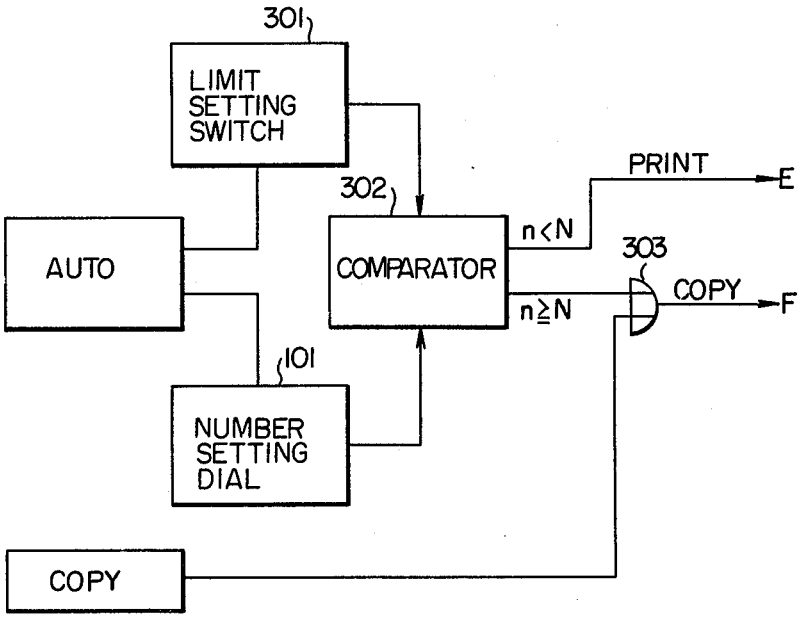

FIGS. 5*a* to 5*c* illustrate the state of a master sheet being fed onto the stock tray shown in FIG. 4; and FIG. 6 is a circuit diagram of a number-of-reproductions setting and selecting circuit connected to key switches labeled "AUTO" and "COPY".

Figure 1:
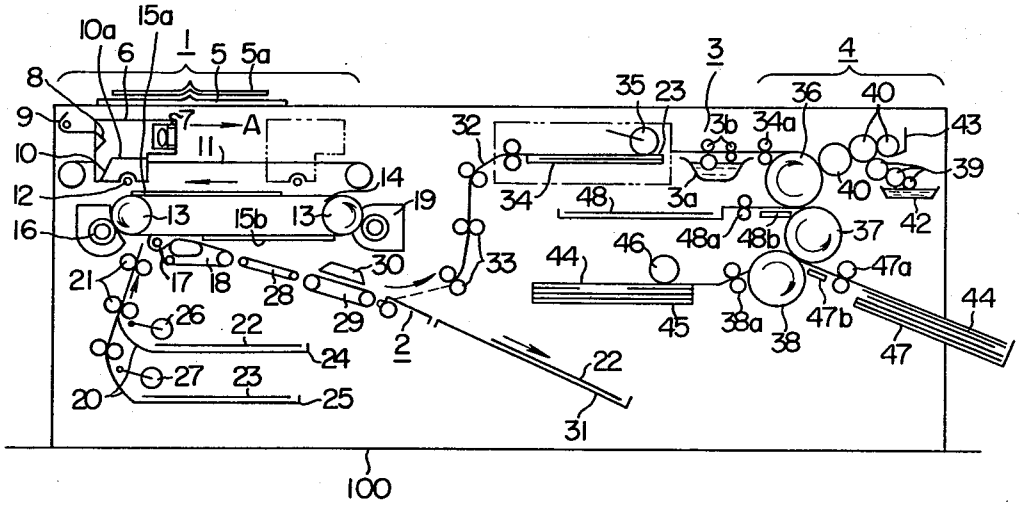
FIG. 1 is a schematic elevational view showing the general structure of a preferred embodiment of the copying and printing apparatus according to the present invention.

Referring now to FIG. 1 showing schematically the general structure of a preferred embodiment of the copying and printing apparatus according to the present invention, an electronic copying device 1, a change-over mechanism 2, an etching station 3 and a printing device 4 are housed within a cabinet 100. The electronic copying device 1 includes a table 5 for mounting an original 5*a* such as a sheet or a page of a book to be reproduced, and a frame 6 supporting an optical system provided for projecting the image of the original 5*a*. This optical system includes an "in-prism lens" 7 composed of a rectangular prism and a lens for the image reversal, a reflector 8, a lamp 9 illuminating the original 5*a*, and a light intensity regulating stop 10 rockably mounted on a stay 10*a*. The "in-prism lens" means a combination of a lens and a prism disposed adjacent to the lens in such manner the light passing through the lens can be again pass through the same lens after the refection by the prism. The frame 6 supporting the optical system is attached to a movable belt 11, and a corona discharge unit 12 is mounted on the lower part of the supporting frame 6. A belt 14 is trained around a pair of spaced pulleys 13 disposed beneath the supporting frame 6, and a pair of electrophotographic sensitive sheets 15*a* and 15*b* are removably carried by this belt 14. A developing unit 16, an image-transfer corona discharge unit 17, an image-transferred sheet separating unit 18, and a cleaning unit 19 cleaning the electrophotographic sensitive sheets 15*a* and 15*b* after the image transfer are disposed along the moving path of the electrophotographic sensitive sheets 15*a* and 15*b*. The sheet separating unit 18 includes a vacuum box therein which is encompassed by a plurality of belts trained around a driving pulley and a driven pulley. A sheet feeding unit including a guide member 20 and a plurality of feed rollers 21 is disposed substantially vertically between the developing unit 16 and the corona discharge unit 17. A first stock tray 24 for stocking copying sheets and a second stock tray 25 for stocking master sheets are disposed adjacent to the lower end of the sheet feeding unit, and a pair of rollers 26 and 27 are disposed above the first and second stock trays 24 and 25 respectively so as to be engageable with the uppermost one of the copying sheets 22 and master sheets 23 respectively. Conveyor belts 28 and 29 are disposed on the right-hand side of the sheet separating unit 18, and a fixing unit 30 is disposed above the latter conveyor belt 29.

The change-over mechanism 2 is disposed on the right-hand side of the conveyor belt 29 having the fixing unit 30 associated therewith. A rotary solenoid 110 (FIG. 2) operating in response to the application of a setting signal as described later is connected to this change-over mechanism 2, so that the change-over mechanism 2 can be brought to the position shown by the solid line when, for example, the setting signal instructs that copying on the copying sheets 22 by the electronic copying device 1 is merely required (COPY MODE). On the other hand, the change-over mechanism 2 is shifted to the position shown by the dotted line when the setting signal instructs that prints be produced by the printing device 4 as described later (PRINT MODE). Adjacent to the solid-line position of the change-over mechanism 2, a sheet receiving tray 31 is disposed to receive the copying sheets 22 having been subjected to the image transfer, while adjacent to the dotted-line position of the change-over mechanism 2, a sheet transfer unit including a guide member 32 and a plurality of feed rollers 33 is disposed so that the master sheets 23 having been subjected to the image transfer can be transferred from the electronic copying device 1 to the printing device 4.

A master sheet stock tray 34 is disposed at the delivery side of the sheet transfer unit to stock the master sheets 23 fed by the sheet transfer unit, and the etching station 3 is disposed adjacent to the rear end of the stock tray 34. FIG. 4 shows in detail the structure of the master sheet stock tray 34. Referring to FIG. 4, a master sheet 23 is fed along the guide member 32 into the nip between a pair of feed rollers 50 and 51 to be delivered onto the master sheet stock tray 34. An auxilliary feed roller 52 is driven from the feed roller 50 through pulleys 53, 54 and a belt 55 to assist in the delivery of the master sheet 23 onto the master sheet stock tray 34. A corner separator 56 is disposed at the rear end of the stock tray 34, that is, at the position corresponding to the corner portion of the leading end of the master sheet 23. This corner separator 56 is engaged by a cam 57 to make vertical movement in response to the rocking movement of the cam 57. This cam 57 is linked to the change-over mechanism 2 in FIG. 1 through a lever 58 and a rod 59. When the change-over mechanism 2 is shifted to the master sheet feeding position shown by the dotted line in FIG. 1, the rod 59 is pulled to be displaced to a position as shown by 59*a*, thereby causing rocking movement of the lever 58 and cam 57 to urge them to respective positions as shown by 58*a* and 57*a*. Consequently, the corner separator 56 is urged upward to a position as shown by 56*a* to act as a stopper for the master sheet 23 delivered onto the stock tray 34.

FIGS. 5*a* to 5*c* illustrate the state of the master sheet 23 being delivered onto the master sheet stock tray 34. Referring to FIG. 5*a*, the leading end of the master sheet 23 bears against the corner separator 56*a*, but its trailing end has not yet passed through the master sheet feed rollers 50 and 51. Therefore, the master sheet 23 is raised at its intermediate portion on the master sheet stock tray 34. However, such upward movement of the intermediate portion of the master sheet 23 is restricted by an upper guide 60, and the trailing end portion only of the master sheet 23 is freely raised in a manner as shown in FIG. 5*b*. With the feeding movement of the master sheet feed rollers 50 and 51, the trailing end portion of the master sheet 23 is guided along the circumference of the master sheet feed roller 51 to take an attitude as shown in FIG. 5*c*. A stopper 61 is provided to prevent rearward movement of the master sheet 23. Since the preceding master sheet 23 is stocked already on the master sheet stock tray 34 in the state shown in FIG. 5*c*, a succeeding master sheet 23' will be easily guided beneath the preceding master sheet 23 to be stocked on the master sheet stock tray 34 in an attitude similar to that of the preceding master sheet 23. After all the master sheets 23 have been delivered onto the master sheet stock tray 34, the corner separator 56*a* is forced downward to the original position 56, and a roller 35 is swung to its lower position engaging with the uppermost one of the master sheets 23, so that this master sheet 23 can be supplied to the etching station 3 by the rotation of the roller 35. An electrical control circuit as described later is provided so as to prevent the roller 35 and corner separator 56 from making their downward movement during delivery of the master sheets 23 onto the master sheet stock tray 34.

The etching station 3 includes a processing solution pool 3*a* and a plurality of solution applying rollers 3*b*. The pool 3*a* contains a processing solution which makes etching treatment on the master sheet 23 supplied from the master sheet stock tray 34 by the rotation of the roller 35. The function of this processing solution is such that the region of the master sheet 23 except the transferred image appeared as the result of copying is turned hydrophilic. The rollers 3*b* act to apply this processing solution to the master sheet 23 while it passes through the processing solution pool 3*a*.

Referring to FIG. 1 again, the printing device 4 is disposed at the delivery side of the etching station 3 and includes a plate cylinder 36, a blanket cylinder 37 and an impression cylinder 38. A bank of inking rollers 40 and a bank of damping rollers 39 are arranged to cooperate with a roller 41 which engages with the cylindrical surface of the plate cylinder 36. A cleaning unit (not shown) for removing the ink image on the blanket cylinder 37 is disposed adjacent to the cylindrical surface of the blanket cylinder 37. Ink and water are supplied to the inking rollers 40 and damping rollers 39 from an ink fountain 43 and a water fountain 42 respectively. A printing sheet stock tray 45 for stocking printing sheets 44 is disposed on the left-hand side of the blanket cylinder 37 and impression cylinder 38, and a roller 46 is disposed above this printing sheet stock tray 45. A print receiving tray 47 receiving the printed sheets 44 is disposed on the right-hand side of the blanket cylinder 37 and impression cylinder 38. Beneath the master sheet stock tray 34, a waste sheet receiving tray 48 is disposed for receiving the printing masters having been used for printing. Feed rollers 38*a* are provided for feeding the printing sheets 44 from the printing sheet stock tray 45. Feed rollers 47*a* and a guide member 47*b* are provided for delivering the printed sheets 44 onto the print receiving tray 47. Feed rollers 48*a* and a guide member 48*b* are provided for feeding the used printing masters onto the waste sheet receiving tray 48.

Figure 2:
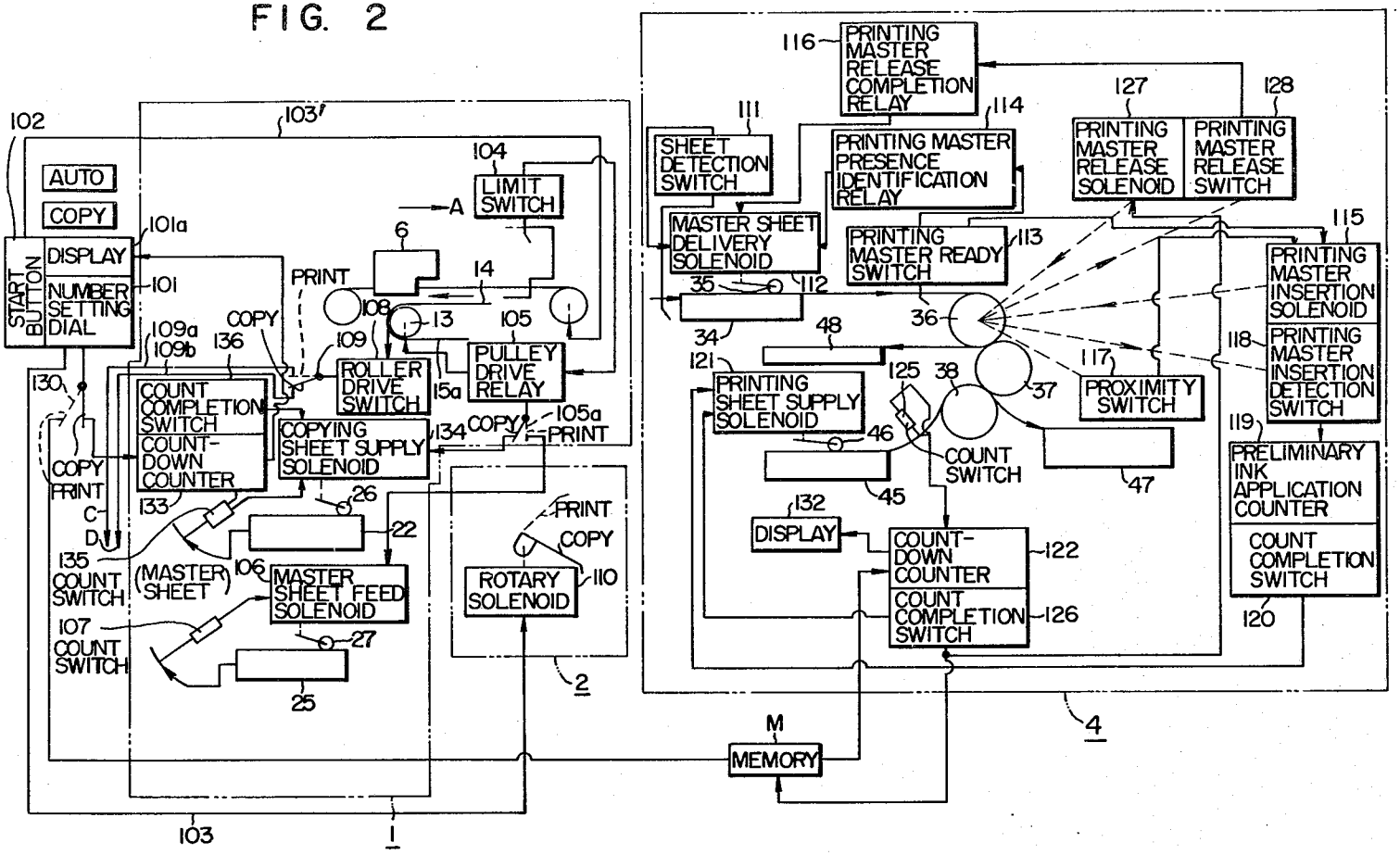
FIG. 2 is a block diagram of an electric control system preferably used in the copying and printing apparatus shown in FIG. 1.

FIG. 2 is a block diagram of a electric control system including various switches, solenoids, etc. for causing sequential operation of the individual elements shown in FIG. 1. The operation of the apparatus shown in FIG. 1 will be described in conjunction with the operation of the electric control system shown in FIG. 2.

In the case of printing using a printing master, a key switch "AUTO" provided on the cabinet 100 is depressed, and then, a number setting dial 101 is set at a number N which exceeds a predetermined limit n set at a limit setting switch 301 shown in FIG. 6. As described previously, this limit n represents the boundary value of economical copying operation of the electronic copying device 1, and when this limit n is exceeded, printing by the printing device 4 is more advantageous. In response to the depression of the dial 101, the number N is displayed on a display 101*a*. Referring to FIG. 6, a comparator 302 compares the number N provided by the dial 101 with the predetermined limit n provided by the limit setting switch 301. When the comparator 302 identifies that $n < N$, it applies a "PRINT" signal E to the rotary solenoid 110 and to change-over switches 105*a*, 109 and 130, thereby shifting the change-over mechanism 2 and change-over switches 105*a*, 109 and 130 to the "PRINT" position. Then, when a start button 102 is depressed, power is supplied to a power input line 103'. The optical-system supporting frame 6 is immediately urged in a direction as shown by the arrow A, and at the same time, the lamp 9 and corona discharge unit 12 supported by the frame 6 are simultaneously energized so that an electrostatic latent image of the image of an original 5*a* placed on the table 5 is formed on the electrophotographic sensitive sheet 15*a* in usual manner. When the frame 6 has been moved to the dotted-line position to complete the formation of the latent image on the sensitive sheet 15*a*, the frame 6 engages with a limit switch 104 to turn on this switch 104. Consequently, a pulley drive relay 105 is energized to drive the pulleys 13 thereby causing movement of the belt 14 carrying the sensitive sheet 15*a* in a direction as shown by the arrow in FIG. 1. At the same time, a master sheet feed solenoid 106 is energized through the change-over switch 105*a* which has been shifted to its "PRINT" position by the output signal E of the comparator 302, and the roller 27 is rotated due to the energization of the solenoid 106. The uppermost one of the master sheets 23 on the master sheet stock tray 25 is fed by the rotating roller 27 into the feeding unit composed of the guide member 20 and feed rollers 21 shown in FIG. 1. When the leading end of this master sheet 23 engages with a master sheet count switch 107 to turn on this switch 107, its output signal is applied to the master sheet feed solenoid 106 to de-energize this solenoid 106 thereby stopping the rotation of the roller 27. The feed rollers 21 holding the master sheet 23 cease to rotate too. When the leading end of the sensitive sheet 15*a* moving in the direction of the arrow passes through the developing unit 16 to arrive at a position immediately forward of the corona discharge unit 17, a roller drive switch 108 is turned on, and its output signal C appears in a line 109*a* leading to the change-over switch 109 (which is now in its "PRINT" position) thereby driving the feed rollers 21 of the feeding unit again. Therefore, the sensitive sheet 15*a* and the master sheet 23 are advanced toward the corona discharge unit 17 while maintaining a predetermined accurate interrelation between their leading ends, so that the toner image formed on the sensitive sheet 15*a* is transferred onto the master sheet 23. In the present embodiment, the master sheet 23 need not necessarily be photosensitive since the image is formed or transferred on the master sheet 23 in the manner above described. The image transfer is competed while the sheets 15*a* and 23 are being advanced past the corona discharge unit 17. When the leading ends of the sensitive sheet 15*a* and master sheet 23 arrive at the sheet separating unit 18, the master sheet 23 starts to be separated from the sensitive sheet 15*a* by the action of vacuum applied from the vacuum box in the sheet separating unit 18, and the separated master sheet 23 is delivered from the belts of the sheet separating unit 18 onto the conveyor belts 28 and 29 of the conveying unit. The toner transfer image formed on the master sheet 23 delivered onto the conveyor belt 29 is heated by a heat source in the fixing unit 30 to be fixed on the master sheet 23, thereby providing a first master. During the above movement of the master sheet 23, the other sensitive sheet 15*b* is brought to the predetermined position occupied previously by the sensitive sheet 15*a*. Then, when the dial 101 is manipulated again to set another number N', and the start button 102 is subsequently depressed, another electrostatic latent image is formed on the sensitive sheet 15*b* and is then developed, and then, image transfer and fixing are carried out on a succeeding master sheet 23 to provide a second master, according to the sequential order described with reference to the sensitive sheet 15*a* and associated master sheet 23.

The first master sheet 23 subjected to the fixing treatment by the fixing unit 30 is conveyed toward the change-over mechanism 2 by the conveyor belt 29 of the conveying unit. As described previously, the output signal E of the comparator 302 has been applied to the rotary solenoid 110 to shift the change-over mechanism 2 to its "PRINT" position. Thus, the first master sheet 23 is conveyed into the feeding unit composed of the guide member 32 and feed rollers 33 to be delivered onto the master sheet stock tray 34. Similarly, the second and third master sheets 23 are successively delivered onto the master sheet stock tray 34 to form a stack in which the first master sheet 23 provides the uppermost layer. The above description refers to the operation of the electronic copying device 1.

In the printing device 4, a sheet detection switch 111 is turned on when it detects the leading end of a master sheet 23 transferred by the sheet transfer unit. This switch 111 is turned off when the master sheet 23 is completely received on the master sheet stock tray 34. This on-off signal is applied to a master sheet delivery solenoid 112. In response to the application of the output signal of the sheet detection switch 111 and an output signal of a printing master release completion relay 116 described later, the solenoid 112 is energized to drive the roller 35 so that the uppermost one of the master sheets 23 on the master sheet stock tray 34 is supplied to the etching station 3. In the etching station 3, the rollers 3*b* partly immersed in the processing solution contained in the processing solution pool 3*a* apply the processing solution to the supplied master sheet 23 so that the region having no transfer image formed thereon is turned hydrophilic, and then, the processed master sheet 23 is supplied to the printing device 4 as a printing master.

A printing master ready switch 113 is disposed immediately upstream of the printing device 4 to detect that the printing master 23 is advanced to the position at which it is ready to enter the printing device 4. The switch 113 applies its output signal indicative of detection of the printing master 23 to the master sheet delivery solenoid 112 through a printing master presence identification relay 114 thereby ceasing the rotation of the roller 35. The above output signal of the switch 113 is also applied to a printing to a printing master insertion solenoid 115. This printing master insertion solenoid 115 is energized in response to the application of the output signal of the switch 113 and an output signal of a proximity switch 117 which generates such an output signal by sensing a predetermined rotational phase during each rotation of the plate cylinder 36. In response to the energization of this solenoid 115, printing master insertion rollers 34*a* start to rotate while holding the printing master 23 therebetween so as to advance the printing master 23 toward clamping means (not shown) associated with the plate cylinder 36 to clamp the printing master 23 on the plate cylinder 36 at an appropriate moment. A printing master insertion detection switch 118 is turned on in response to the printing master clamping operation, so that the inking roller bank 40 and damping roller bank 39 operate to form the ink image on the printing master 23 clamped to the cylindrical surface of the plate cylinder 36. At this time, the blanked cylinder 37 is not in contact with the plate cylinder 36 and impression cylinder 38. The amounts of ink and water are previously adjusted to be most suitable for the printing purpose, and no later adjustment is unnecessary.

A preliminary ink application counter 119 is actuated in response to the turn-on of the switch 118. The counter 119 counts the rotation of the plate cylinder 36 and continues to count until one preliminary ink application cycle is completed, that is, until the plate cylinder 36 rotates over a predetermined cycle required to sufficiently apply ink to the printing master 23 clamped to the plate cylinder 36. At the end of the preliminary ink application cycle, the counter 119 generates an output signal for actuating a count completion switch 120. The switch 120 is turned on in response to the application of the output signal of the counter 119 and applies its output signal to a printing sheet supply solenoid 121. In response to the application of the output signal of the count completion switch 120, the solenoid 121 is energized to drive the roller 46 thereby advancing the uppermost printing sheet 44 on the printing sheet stock tray 45 toward and into the feed rollers 38*a*, and this printing sheet 44 fed by thefeed rollers 38*a* is then clamped on the impression cylinder 38 by clamping means (not shown). A printing sheet count switch 125 senses the printing sheet 44 advanced from the stock tray 45 toward the feed rollers 38*a* and applies a pulse to a count-down counter 122 each time it senses a printing sheet 44. In response to the appearance of a first pulse from the count switch 125, the blanket cylinder 38 is brought into rotational contact with the plate cylinder 36 and impression cylinder 38 so that the ink image formed on the printing master 23 clamped to the cylindrical surface of the plate cylinder 36 is transferred to the printing sheet 44 clamped to the cylindrical surface of the impression cylinder 38.

When the count-down counter 122 counts down the number of pulses equal to the desired number of reproductions, the counter 122 generates an output signal for actuating a count completion switch 126. In response to the application of the output signal of the counter 122, the count completion switch 126 acts to de-energize the printing sheet supply solenoid 121 thereby moving the blanket cylinder 37 away from the plate cylinder 36 and impression cylinder 38. As soon as the blanket cylinder 37 is moved away from the plate cylinder 36 and impression cylinder 38, a cleaning unit (not shown) commonly conventionally used in printing presses and the like is actuated to remove the ink image transferred to the cylindrical surface of the blanket cylinder 37. Further, as soon as the blanket cylinder 37 is urged away from the position in rotational contact with the plate cylinder 36 and impression cylinder 38, the switch 126 applies its output signal to a printing master release solenoid 127 to energize this solenoid 127. As a result of the energization of this solenoid 127, the following steps are sequentially carried out. The clamping means associated with the plate cylinder 36 is released, and then, the inking and damping roller banks 40 and 39 cease to operate. A printing master release switch 128 detects that the clamping means associated with the plate cylinder 36 has been released and applies its output signal to the printing master release completion relay 116 to energize this relay 116. In response to the application of the output signal of the printing master release completion relay 116 to the master sheet delivery solenoid 112 when a succeeding master sheet 23 is stocked on the master sheet stock tray 34 and the sheet detection switch 111 is in its on state, the release of the preceding printing master 23 is followed by the insertion of the succeeding printing master 23 so that printing can be carried out in a manner similar to that above described.

The operation of the number setting dial 101 will be described again. The number N of reproductions to be delivered from the apparatus is set by the dial 101. Suppose that this number N is larger than the limit n provided by the limit setting switch 301 shown in FIG. 6. Then, the output signal of the dial 101 is applied through the switch 130 to a supplied printing sheet display 132 and to the count-down counter 122 in the printing device 4. In response to the application of this signal, the display 132 displays the desired number of reproductions set by the dial 101, and the content of the count-down counter 122 is set at the specified number. The control system comprises a memory circuit M including a shift register having a plurality of register stages for sequentially registering the values set by the dial 101 for successive individual pages of a book or the like. The contents of the registers are sequentially read out so that the numbers of reproductions set by the dial 101 can be obtained. When the count-down counter 122 counts down to zero, the counter 122 is cleared, and the contents of the registers are sequentially shifted. At the time at which the last number of reproductions is displayed on the display 132 and set in the count-down counter 122, all the operations in the electronic copying device 1 have already been completed. That is, it is unnecessary to actuate the control system portions associated with the electronic copying device 1 after the master sheets 23 obtained by the copying operation in the electronic copying device 1 for providing the desired numbers of prints set by the dial 101 have been delivered onto the master sheet stock tray 34. Further, the desired number of reproductions set by the dial 101 is shifted therefrom to the count-down 122 and the display 132. As described above, the electronic copying device 1 can now operate independently of the printing device 4 after the last number of reproductions set by the dial 101 has been displayed on the display 132 and set in the counter 122. Therefore, in the state in which the electronic copying device 1 is now idle, copies can be directly obtained as desired by electronic copying even when the printing device 4 is placed in operation.

During printing with a preceding printing master, succeeding master sheets can be prepared and stocked on the master sheet stock tray 34 in the order described already. In such a case, the signals generated by the setting dial 101 are sequentially applied to the memory circuit including the shift register, and the information of the number of prints provided by a succeeding printing master is applied from the memory circuit to be displayed on the display 132 and set in the count-down 122 when the master sheet delivery solenoid 112 is energized by the output signal of the printing master release relay 116 after the completion of printing with the preceding printing master. The number of master sheets 23 stocked in the described order on the master sheet stock tray 34 can be limited by comparing the output pulses of the printing master release completion relay 116 with the output pulses of the master sheet count switch 107, and disabling the change-over of the switches 105*a*, 109 and 130 to the "PRINT" position or generating an alarm signal when the result of comparison attains a predetermined limit.

The electronic copying operation of the apparatus will then be described with reference to the case in which the key switch "COPY" shown in FIG.6 is depressed, or the key switch "AUTO" in FIG. 6 is depressed and the number N of reproductions set by the dial 101 is smaller than the aforementioned limit n provided by the limit setting switch 301. When the key switch "COPY" is depressed, the output signal of the key switch "COPY" or a "COPY" signal F appears directly from an OR gate 303 in FIG. 6 to be applied to the rotary solenoid 110 and to the change-over switches 105*a*, 109 and 130. As a result, the change-over mechanism 2 and the change-over switches 105*a*, 109 and 130 are changed over from the "PRINT" position to the "COPY" position. Due to the change-over of the switches 105*a*, 109 and 130 to the "COPY" position, the signal line of the switch 130, the signal line 109*b* of the switch 109 and the signal line of the switch 105*a* are connected to a count-down counter 133, a signal D and a copying sheet supply solenoid 134 respectively. Then, when the start button 102 is depressed, power is supplied to the power input line 103', and the optical-system supporting frame 6 starts to travel in the direction of the arrow A as in the case of the "PRINT" mode. Then, the electrophotographic sensitive sheet 15*a* carried by the belt 14 is moved in the direction of the arrow by the pulleys 13, and a copying sheet 22 is fed from the copying sheet stock tray 24 by the action of the roller 26 and the feeding unit composed of the guide member 20 and feed rollers 21 shown in FIG. 1. The sensitive sheet 15*a* and copying sheet 22 are advanced toward the corona discharge unit 17 while maintaining a predetermined accurate interrelation between their leading ends. After being separated from the sensitive sheet 15*a* by the sheet separating unit 18, the copying sheet 22 is conveyed by the conveyor belts 28 and 29 to move past the fixing unit 30 and the change-over mechanism 2 to be delivered onto the tray 31 which receives the copying sheet 22. Each time the copying sheet 22 is delivered onto the tray 31 by the conveying unit, a count switch 135 senses it and applies a pulse to the count-down counter 133. After the count-down counter 133 has counted the number of pulses equal to the desired number of copies set by the dial 101, the counter 133 generates an output signal which actuates a count completion switch 136.

In the operating condition in which the key switch "AUTO" is depressed for the purpose of copying, the number N set by the dial 101 is compared by the comparator 302 with the predetermined limit n provided by the limit setting switch 301 in FIG.6. When the result of comparison provides that $n > N$, an output signal F of the comparator 302 passes through the OR gate 303 to be applied to the rotary solenoid 110 and change-over switches 105*a*, 109 and 130. Any detailed description of subsequent operation will be unnecessary since the operation is entirely the same as when the key switch "COPY" is depressed.

Figure 3:
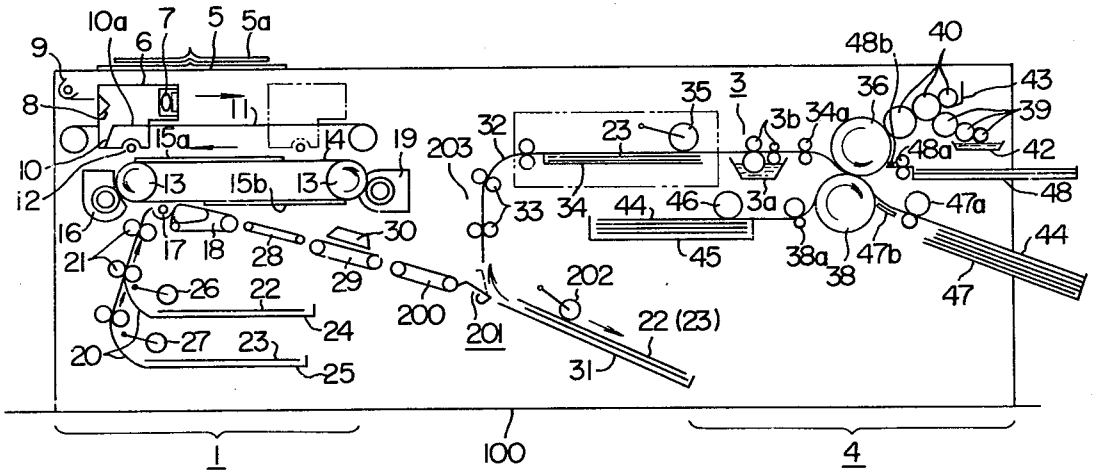
FIG. 3 is a schematic elevational view showing the general structure of another embodiment of the present invention.

In the embodiment of the present invention described hereinbefore, the master sheet 23 is supplied to the printing device 4 with the transfer image facing upward. In another embodiment or a modification of the present invention shown in FIG. 3, the master sheet 23 is supplied to the printing device 4 with the transfer image facing downward so as to eliminate the blanket cylinder 37 interposed between the plate cylinder 36 and the impression cylinder 38. Referring to FIG. 3, the master sheet 23 is delivered from a conveyor belt 200 onto the master sheet receiving tray 31 past a change-over mechanism 201 which is placed in the solid-line position. Then, the change-over mechanism 201 is changed over to the position shown by the two-dot chain line, and the master sheet 23 is delivered from the tray 31 by the rotation of a roller 202. The master sheet 23 is then transferred through a sheet transfer unit 203, master sheet stock tray 34 and etching station 3 to the underside of the plate cylinder 36 to be clamped on the cylindrical surface of the plate cylinder 36. This arrangement eliminates the blanket cylinder 37 interposed between the plate cylinder 36 and the impression cylinder 38 shown in FIG. 1.

In the embodiments of the present invention, an in-prism lens provided by the combination of a rectangular prism and a lens is merely referred to as an element of the optical system for electronic copying. Actually, however, the apparatus according to the present invention includes, in addition to the in-prism lens, "an in-mirror lens" provided by the combination of a mirror and a lens so that the in-mirror lens can be selectively used in the case of printing in which the image reversal is unnecessary. In the embodiments of the present invention, the so-called dry electronic copying process is employed for the preparation of the printing master. The "in-mirror lens" means a combination of a lens and a mirror disposed adjacent to the lens in such manner that the surface of the mirror is perpendicular to the optical axis of the lens and the light passing through the lens can be again pass the same lens after the reflection on the mirror's surface. It will be readily understood, however, that this dry process may be replaced by the wet process.

We claim:

1. A copying and printing apparatus including an integral combination of an electronic copying device and a printing device adapted to use a reproduction provided by said electronic copying device as a master sheet, comprising number setting means for setting a desired number N of reproductions, reference number n setting means for setting a reference number n of reproductions, control means including a comparator for controlling the reproducing operation for the desired number N of reproductions by said electronic copying device when said comparator detects that the desired number of copies N is equal to or smaller than the reference number n of reproductions, and for automatically controlling the initiaton of a printing operation utilizing the reproduction provided by said electronic copying device as the master sheet when said comparator detects that the desired number N of copies is larger than the reference number n of reproductions, and means for shifting the desired number N of reproductions set in said number setting means when said master sheet is forwarded to the printing device side under the conditon of $N > n$, and for storing the shifted number N or reproductions, wherein after the completion of the shift said number setting means can be set with a newly desired number N' of reproductions and if the number N' is equal to or smaller than the reference number n the copying operation by said electronic copying device can be independently conducted without regard to the conducting of the printing operation by said printing device.

2. A copying and printing apparatus comprising a conbination of a copying device and a printing device in which said copying device is independently operable as a unit with respect to said printing device, and copies produced by said copying device can be selectively delivered to a delivery portion of said copying device or supplied to said printing device, and wherein;

(1) said copying device comprises electronic copying means, first specifying means for selectively specifying a copy mode and a print mode, a second specifying means for specifying the number of reproductions, and means for stocking sheets, and copying control means for controlling the copying operations of said electronic copying means, said copying control means including means responsive to the print mode specified by said first specifying means for actuating said electronic copying means to copy the image of each individual original on a sheet thereby preparing a printing copy, means for transferring the information specified by said second specifying means to printing control means and then resetting the information specified by said first and second specifying means, means responsive to the copy mode specified by said first specifying means for actuating said electronic copying means to copy the image of each individual original on sheets by the number specified by said second specifying means thereby providing copies, and means for resetting the information specified by first and second specifying means;

(2) a selective delivery station for selectively delivering the printing copy to a first stocker and the copies to a second stocker when said electronic copying means is operating in the print mode and copy mode respectively; and (3) said printing device comprises printing means, means for taking out the first one of a plurality of printing copies stocked sequentially on said first stocker and turning it into a printing means to obtain prints by the number specified by said second specifying means, and means for removing the printing master from said printing means to place said printing means in its non-operating state, and printing control means for controlling the printing operation of said printing means, said printing control means including a plurality of registers for sequentially receiving the information specified by said second specifying means for the individual originals in the print mode and storing the information according to the order transferred from said copying control means, and means for sequentially reading out the information stored in said registers so that said printing means can provide prints of the individual originals by the individual numbers instructed by the information read out sequentially from said registers.

3. A copying and printing apparatus as claimed in claim 2, further comprising automatic selective control means including means for comparing the number of reproductions specified by said second specifying means with a predetermined setting, and means responsive to the result of comparison by said comparing means for automatically selecting either the copy mode or the print mode.

4. A copying and printing apparatus as claimed in claim 2 or 3, wherein said sheet stocking means in said electronic copying device stocks sheets of different qualities, and sheet supplying means is provided so that the sheet of the quality corresponding to the copy mode or print mode can be supplied to said electronic copying means when the copy mode or print mode is specified by said first specifying means or when either mode is automatically selected.

5. A copying and printing apparatus as claimed in claim 1, wherein said sheet stocking means in said electronic copying device includes two kinds of sheet stockers for stocking sheets which are used for providing printing masters and sheets which are not used as printing masters.

6. A copying and printing apparatus as claimed in claim 2, wherein said printing means in said printing device coupled to said electronic copying device is of the three-cylinder offset printing type.

7. A copying and printing apparatus as claimed in claim 2, wherein said printing means in said printing device coupled to said electronic copying device is of the two-cylinder direct printing type.

8. A copying and printing apparatus as claimed in claim 2, wherein said electronic copying means includes an optical system including first lens means and second lens means which are selectively used for projecting a positive image and a reversed image of an origional as required.

* * * * *